US010948180B2

(12) United States Patent
Chyou et al.

(10) Patent No.: US 10,948,180 B2
(45) Date of Patent: Mar. 16, 2021

(54) GASIFICATION REACTOR WITH SHARED PARTIAL REACTOR VESSELS

(71) Applicant: Institute of Nuclear Energy Research, Atomic Energy Council, Executive Yaun, R.O.C., Taoyuan (TW)

(72) Inventors: Yau-Pin Chyou, Taoyuan (TW); Po-Chuang Chen, Taoyuan (TW); Keng-Tung Wu, Taichung (TW); Rei-Yu Chein, Taichung (TW)

(73) Assignee: Institute of Nuclear Energy Research, Atomic Energy Council, Executive Yuan, R.O.C., Taoyuan (TW)

( * ) Notice: Subject to any disclaimer, the term of this patent is extended or adjusted under 35 U.S.C. 154(b) by 0 days.

(21) Appl. No.: 16/561,151

(22) Filed: Sep. 5, 2019

(65) Prior Publication Data

US 2020/0191384 A1 Jun. 18, 2020

(30) Foreign Application Priority Data

Dec. 12, 2018 (TW) ..... 10714484.3

(51) Int. Cl.

| | |
|---|---|
| ***F23C 10/00*** | (2006.01) |
| ***F23C 10/06*** | (2006.01) |
| ***C10J 3/46*** | (2006.01) |
| ***F27D 99/00*** | (2010.01) |
| ***F27D 17/00*** | (2006.01) |

(52) U.S. Cl.

CPC ..... *F23C 10/005* (2013.01); *C10J 3/463* (2013.01); *F23C 10/06* (2013.01); *C10J 2300/1637* (2013.01); *F23C 2202/30* (2013.01); *F23G 2203/503* (2013.01); *F27D 2017/006* (2013.01); *F27D 2099/0048* (2013.01)

(58) Field of Classification Search

CPC ..... C10J 3/463; C10J 3/1637; C10J 3/0993; C10J 3/1625

See application file for complete search history.

(56) References Cited

U.S. PATENT DOCUMENTS

| | | | | |
|---|---|---|---|---|
| 4,002,438 A * | 1/1977 | Fleming | B01J 8/1854 48/76 |
| 7,951,350 B1 * | 5/2011 | Taylor | C10K 1/06 423/418.2 |
| 2014/0296586 A1 * | 10/2014 | Chandran | C10G 1/02 585/240 |
| 2014/0314629 A1 * | 10/2014 | Lee | C10J 3/485 422/139 |
| 2017/0037328 A1 * | 2/2017 | Wormser | C10B 49/10 |

FOREIGN PATENT DOCUMENTS

| | | | | |
|---|---|---|---|---|
| JP | 2010018747 A * | 1/2010 | | C10J 3/723 |
| JP | 2010018749 A * | 1/2010 | | F23C 10/26 |

* cited by examiner

*Primary Examiner* — Matthew J Merkling

(74) *Attorney, Agent, or Firm* — Demian K. Jackson; Jackson IPG PLLC

(57) ABSTRACT

A gasification reactor is provided. The reactor comprises a first gasification area, a second gasification area and a shared combustion area. The shared combustion area is set between the first and second gasification areas. Therein, the (present invention applies interconnected fluidized beds in gasification. The connecting piping between the first and second gasification areas are separately replaced with dense beds to be integrated for forming a single reactor. Thus, the present invention simplifies the system, saves the cost and reduces the operation difficulty.

12 Claims, 3 Drawing Sheets

GASIFICATION REACTOR WITH SHARED PARTIAL REACTOR VESSELS

TECHNICAL FIELD OF THE INVENTION

The present invention relates to a gasification reactor; more particularly, to applying inter-connected fluidized beds in gasification, where connecting vessels between first and second gasification areas are separately replaced with dense beds to be integrated for forming a single reactor.

DESCRIPTION OF THE RELATED ARTS

Regarding existing prior arts, United States patent 2015361362 discloses a process for the catalytic gasification of carbonaceous raw material. The patent separates reactions into two comprising one in a gasification area and another in a combustion area with piping connecting the two areas. Yet, there are design and safety issues along with the issue of the follow-up maintenance of the piping. Not only the system is complex and the cost is high, but also the difficulty of system operation is increased. Another prior art, U.S. Pat. No. 9,644,152, discloses a method and apparatus of supplying hydrogen to catalytic hydrogenation. A pretreatment reaction zone is added at bottom of a gasifier, where the material fed is decomposed below 500 Celsius degrees (° C.) at first to enhance the performance of the upper-end gasification. Although the reactor has two separated reaction zones, reactions processed are sequential and products are not separable.

In addition, another prior art is an indirect gasification system from the Gussing area, Austria. The whole process of reactions is realized by using a fast circulating fluidized bed and a bubble fluidized bed to be connected through upper and lower seals 1011,1021 (as shown in FIG. 3; document source: Schmid, J C; Wolfesberger U.; Koppatz S.; Pfeifer C.; Hofbauer H., Variation of Feedstock in a Dual Fluidized Bed Steam Gasifier-Influence on Product Gas, Tar Content, and Composition, Environ Prog. Sustain. Energy 2012, 31, 205-215, 0.1002/ep.11607.) The bed material used is an inert material circulated between a combustion reactor 101 and a gasification reactor 102 to be a heat carrier delivering heat from a self-combustion zone to a gasification zone. A carbonaceous material is supplied to the gasification zone to be gasified in a steam-containing atmosphere to be converted into a synthesis gas composed of carbon monoxide (CO), hydrogen ($H_2$) and carbon dioxide ($CO_2$). Because steam is used to replace air as a gasifying agent, the gas generated in the zone does not contain nitrogen. The heat carrier in the bed provides heat for gasification reactions and, then, is recycled to the self-combustion zone with unreacted carbon. The self-combustion zone is injected with air to be fluidized for processing combustion with the unreacted carbon. The heat carrier is then heated up by an exothermic reaction in the combustion zone to provide required endothermic energy for gasification reactions. Hence, the heat carrier at the outlet of the self-combustion zone has a higher temperature than that at the inlet. After being processed with a cyclone separator 103, a flue gas is discharged from the chimney without contacting product gases, which reduces the concentration of available gas.

FIG. 3 shows an apparatus using existing technologies. The gasification reactor processes reactions in two separated zones, i.e. a gasification zone and a combustion zone. Two reactors 101, 102 are connected with seals, which tends to have problems of piping blockage and subsequent piping maintenance. Not only the system is complex and the cost is high, but also the difficulty of system operation is increased.

Although some studies on fluidized beds are conducted, commercial biomass gasification reactor is not found. However, a pulverized-coal-fired boiler can be added with a biomass gasification reactor to make the coal boiler obtain the capacity of processing biomass material/waste. Biomass resources can be fully used to be converted into usable energy for enhancing the use of renewable energy. Therefore, as earth greenhouse effect becomes more serious and environmental-protection consciousness for carbon reduction is awakened, the technologies based on replacing fossil fuels with fuels obtained through biomass gasification will be a novel way to improve and develop green energies.

Hence, technical requirements of carbon reduction, waste recycling and recycling economy have great market potentials with reduction targets being set and green energy ratio being actively increased. Yet, as shown in the above techniques, although the development of current international energy-saving and carbon-reducing technologies are a few together with related fluidized-bed gasification technologies, related applications and ideas are not found the same as the present invention in the sub-field of interconnected fluidized beds. Hence, the prior arts do not fulfill all users' requests on actual use.

SUMMARY OF THE INVENTION

The main purpose of the present invention is to apply interconnected fluidized beds in gasification, where connecting vessels between first and second gasification areas are separately replaced with dense beds to be integrated for forming a single reactor; the system is simplified, the cost is saved and the operation difficulty is reduced; by applying the connection characteristic of interconnected cavity areas, an additional gasification area can connect to a combustion area at the other end and, thereby, two or more separated source materials is simultaneous processed; and the design of the shared combustion area saves operating cost and further cuts down the occupation of land and space to benefit in industrial development.

Another purpose of the present invention is to use interconnected fluidized beds as a carrier of the art to realize indirect gasification, where, as compared to prior arts, by the design of dense beds, required piping connections and easily-blocked seals are replaced so that the geometry of the reactor is simplified and the operation of the reactor is more convenient; and, because the seals are replaced by reactor cavities and the conveyance of bed material and airtightness are realized by the design of weir egresses and orifices, the scalability and flexibility for expanding system are achieved.

To achieve the above purposes, the present invention is a gasification reactor with shared partial reactor vessels, being applied with interconnected fluidized beds to process gasification by replacing connecting piping between two reaction areas to obtain an integrated single reactor distributed with bed material and comprising a first gasification area, a second gasification area and a shared combustion area, where the first gasification area comprises a first gasification zone and a first dense bed; a first weir egress is set at a top end of a side wall of the first gasification zone; a first orifice is set on at a bottom end of a side wall of the first dense bed to connect to the first gasification zone; the second gasification area comprises a second gasification zone and a second dense bed; a second weir egress is set at a top end of a side wall of the second gasification zone; a second orifice is set on at a bottom end of a side wall of the second dense bed to connect to the second gasification zone; the shared combustion area is set between and communicated with the first and second gasification areas; the shared combustion area comprises a combustion zone and a third dense bed; the third dense bed isolates gases of the combustion zone from the first and second gasification areas; a third orifice is set on at a bottom end of a side wall of the third dense bed to connect to the combustion zone; the third dense bed communicates with the first and second gasification zones through the first and second weir egresses at upper ends of two side walls of the third dense bed, respectively; and the combustion zone communicates with each of the first and second dense beds through a third weir egress at a top end of a corresponding one of side walls of the combustion zone, respectively. Accordingly, a novel gasification reactor with shared partial reactor vessels is obtained.

BRIEF DESCRIPTION OF THE DRAWINGS

The present invention will be better understood from the following detailed description of the preferred embodiment according to the present invention, taken in conjunction with the accompanying drawings, in which.

DESCRIPTION OF THE PREFERRED EMBODIMENT

The following description of the preferred embodiment is provided to understand the features and the structures of the present invention.

The major difference between gasification and combustion lies on that combustion burns all matters to obtain energy, where carbon completely becomes carbon dioxide ($CO_2$); yet, gasification is an oxygen-depleted reaction, where source materials produce combustible gases, like carbon monoxide (CO), hydrogen ($H_2$), etc., of value for further burning and other utilization. Hence, after being fed into a gasification reactor according to the present invention, solid, liquid or gas source materials are converted into valuable gases (generally referred to as synthesis gases), like CO and $H_2$.

Figure 1:
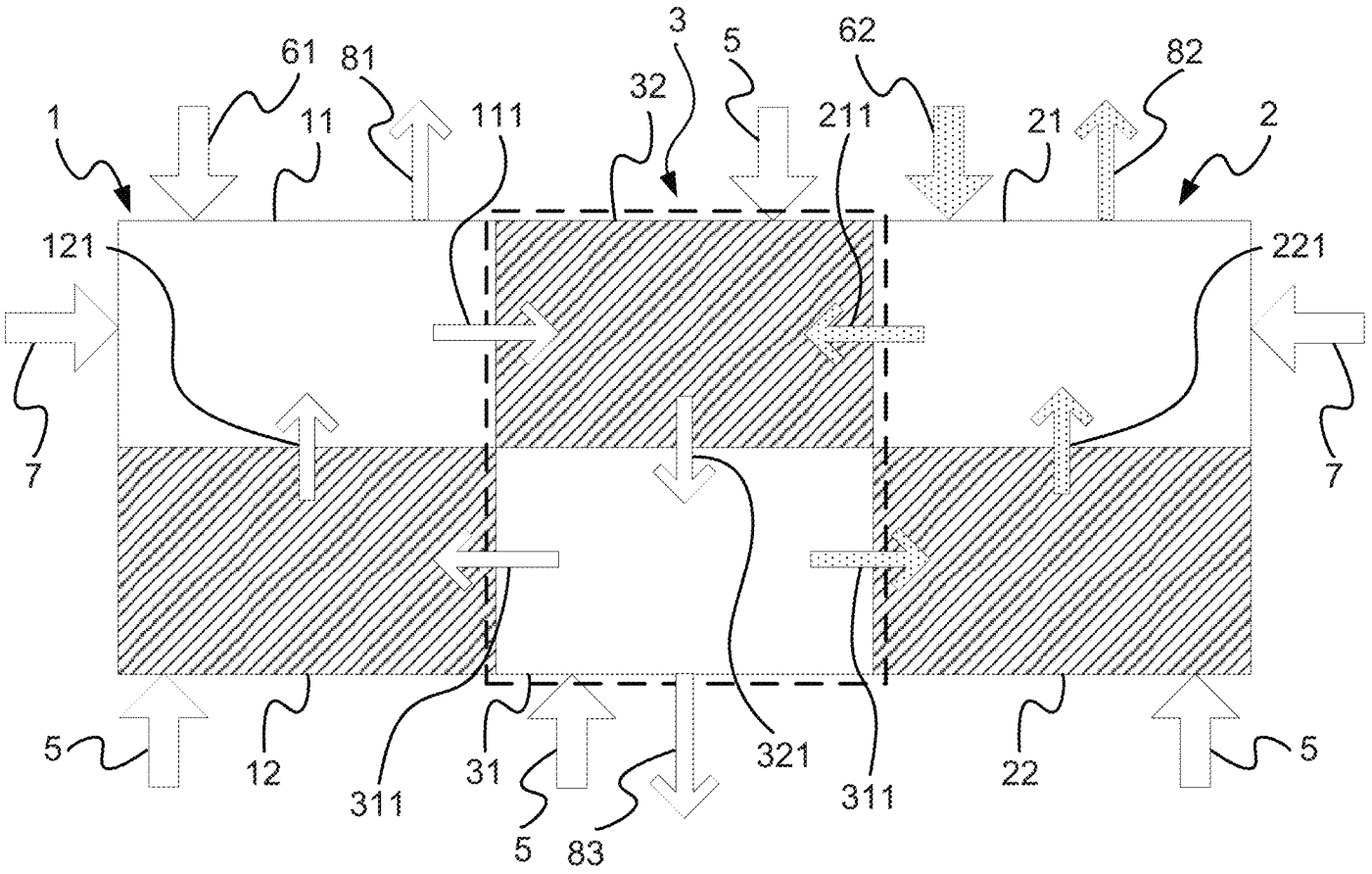
FIG. 1 is the view showing the internal structure of the preferred embodiment according to the present invention.
Figure 2:
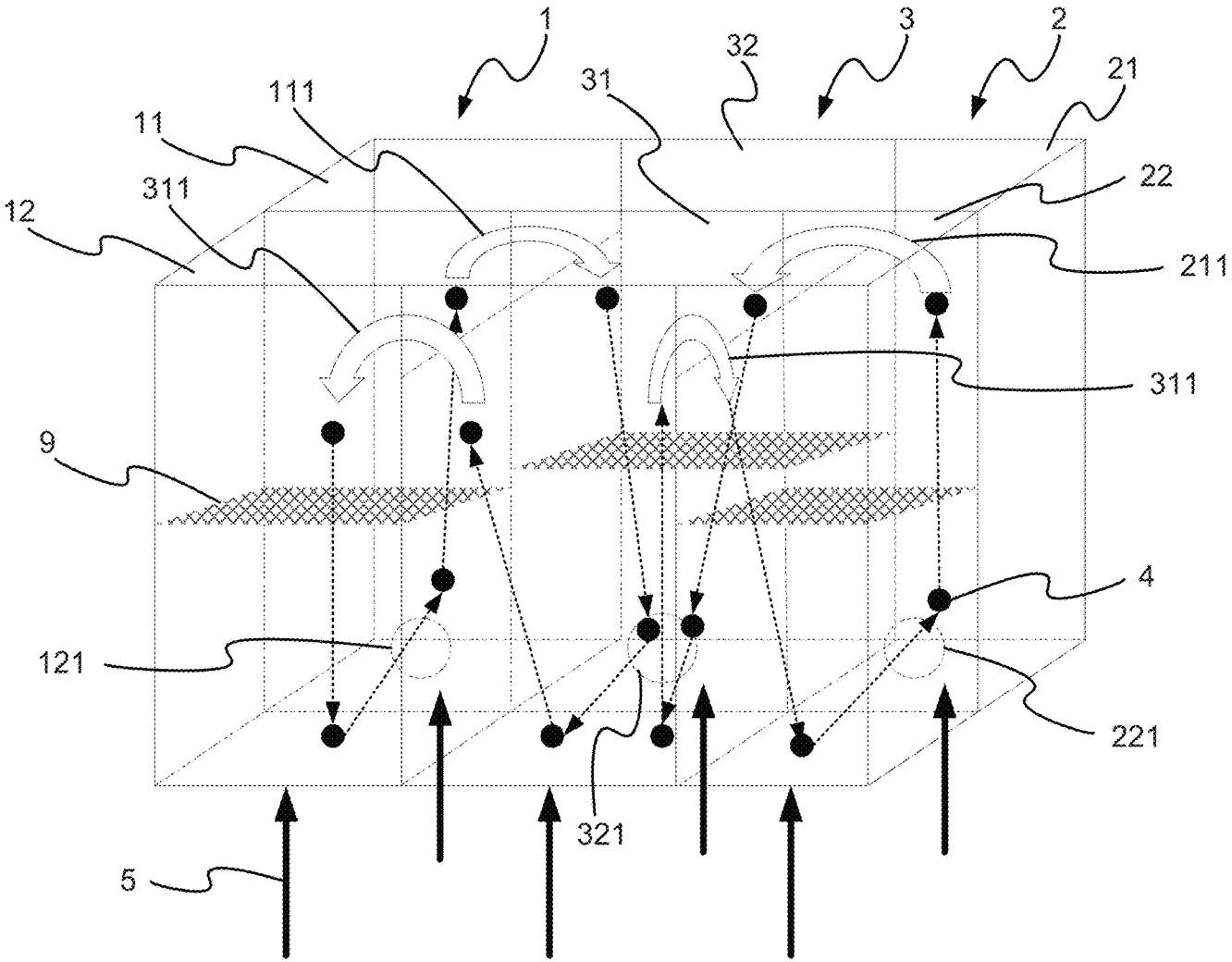
FIG. 2 is the 3-dimensional (3D) view showing the flow of the bed material.
Figure 3:
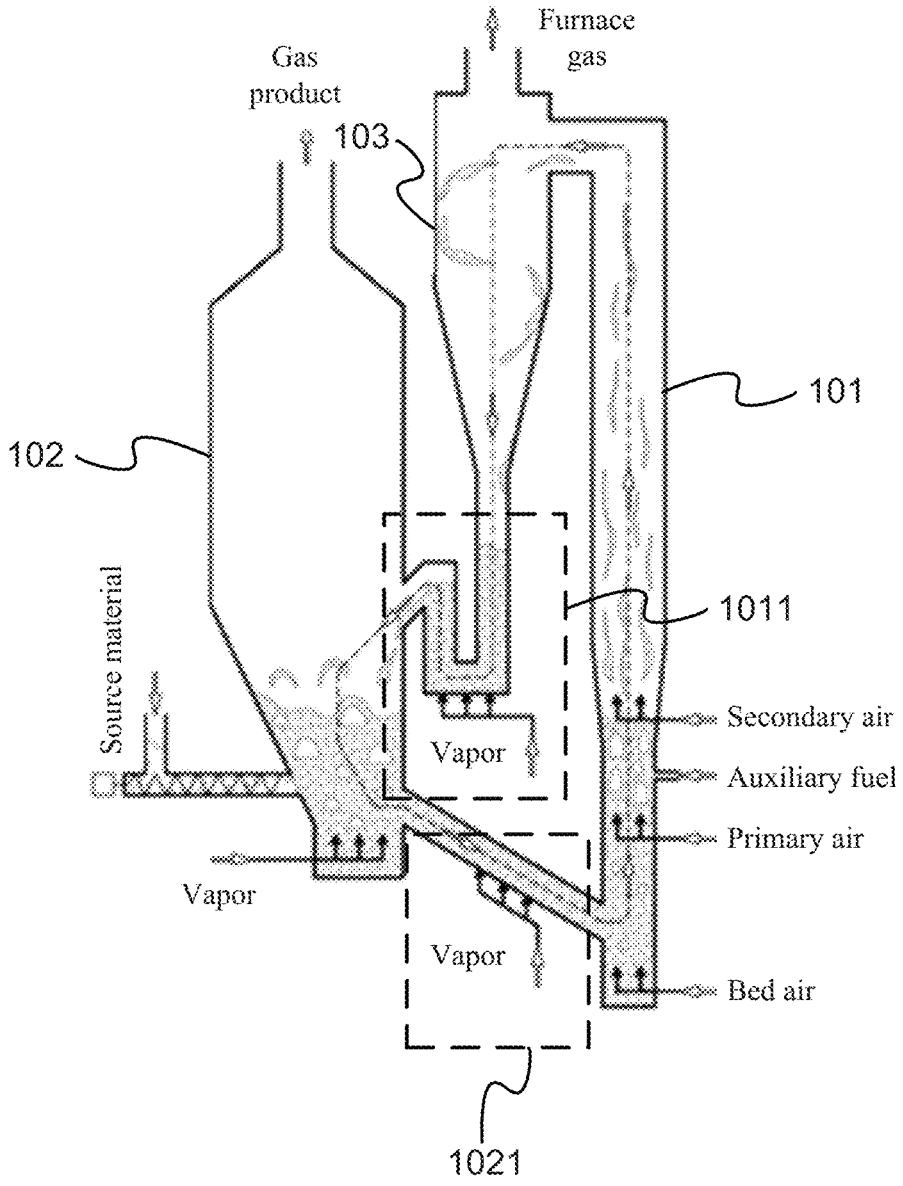
FIG.3 (Prior art)
FIG. 3 is the view of the prior art.

Please refer to FIG. 1 and FIG. 2, which are a view showing an internal structure of a preferred embodiment according to the present invention; and a 3D view showing the flow of bed materials. As shown in the figures, the present invention is a gasification reactor with shared partial reactor vessels, comprising a first gasification area 1, a second gasification area 2 and a shared combustion area 3, where the shared combustion area 3 is set between the first and second gasification areas 1, 2 and a bed material 4 is distributed within the gasification reactor.

The first gasification area 1 comprises a first gasification zone 11 and a first dense bed 12. A first weir egress 111 is set at a top end of a side wall of the first gasification zone 11. A first orifice 121 is set on at a bottom end of a side wall of the first dense bed 12 to connect to the first gasification zone 11. The first gasification area 1 introduces a fluidizing gas 5 to the first dense bed 12. The bed material 4 enters the first gasification zone 11 through the first orifice 121 at a bottom end of the first dense bed 12. A first source material 61 and a gasifying agent 7 are added into the first gasification zone 11 to process gasification to obtain a combustible gas 81. Unreacted part of the first source material 61 and the bed material 4 in the first gasification zone 11 are carried by the fluidizing gas 5 to flow across the first weir egress 111.

The second gasification area 2 comprises a second gasification zone 21 and a second dense bed 22. A second weir egress 211 is set at a top end of a side wall of the second gasification zone 21. A second orifice 221 is set on at a bottom end of a side wall of the second dense bed 22 to connect to the second gasification zone 21. The second gasification area 2 introduces a fluidizing gas 5 to the second dense bed 22. The bed material 4 enters the second gasification zone 21 through the second orifice 221 at a bottom end of the second dense bed 22. A second source material 62 and a gasifying agent 7 are added into the second gasification zone 21 to process gasification to generate a combustible gas 82. Unreacted part of the second source material 62 and the bed material 4 in the second gasification zone 21 are carried by the fluidizing gas 5 to flow across the second weir egress 211.

The shared combustion area 3 is set between the first and second gasification areas 1, 2, comprising a combustion zone 3 and a third dense bed 32. A third orifice 321 is set on at a bottom end of a side wall of the third dense bed 32 to connect to the combustion zone 31. The third dense bed 32 communicates with the first and second gasification zones 11, 12 through the first and second weir egresses 111, 211 at top ends of two side walls of the third dense bed 32, respectively. The combustion zone 31 communicates with each of the first and second dense beds 11, 21 through a third weir egress 311 at a top end of a corresponding one of side walls of the combustion zone 31, respectively. The shared combustion area 3 introduces a fluidizing gas 5 to the third dense bed 32. After entering into the third dense bed 32 through the first or second weir egress 111, 211 to be accumulated at a bottom end, the bed material 4 conveys unreacted part of the first or second source material 61, 62 to the combustion zone 31 through the third orifice 321, respectively. Therein, unreacted part of the first or second source material 61, 62 is reacted in the shared combustion area 3 to heat up the bed material 4 and generate $CO_2$ 83 after complete combustion is finished. The bed material 4 heated-up enters into the first or second dense bed 12, 22 through the third weir egress 311 at a top end; and, then, is conveyed back to the first or second gasification zone 11, 21 through the first or second orifices 121, 221, respectively. Consequently, a whole cycle as described above is formed to be processed repeatedly. Thus, a novel gasification reactor with shared partial reactor vessels is obtained.

The gasification reactor according to the present invention is connected with at least one feeding module (not shown in the figures) to feed the first and second source materials 61, 62. The first and second source materials 61, 62 are each a solid material, a liquid material or a gas material; but are different materials containing carbon.

The gasification reactor according to the present invention is connected with at least one gas supply module (not shown in the figures) to provide the gasifying agent 7 (e.g. air, vapor or an oxygen-rich gas) to the first or second gasification zone 11, 21 for gasifying the first or second source material 61, 62 to be converted into a combustible gas 81, 82, respectively; and provide the gasifying agent 7 (e.g. air or an oxygen-rich gas) into the combustion zone 31 to heat up the bed material 4 and generate a flue gas or a high-purity gas of $CO_2$ 83. Therein, by processing the whole cycle, the bed material 4 provides energy required during gasification in the first or second gasification zone 11, 21; or helps maintaining a reaction temperature (usually 700~900° C.).

On using the present invention, in the preferred embodiment as shown in FIG. 1 and FIG. 2, the material looping internally is a medium of a fluidized bed, i.e. the bed material 4 (e.g. silica sand). There are two things pass from the first gasification zone 11 to the third dense bed 32: one is the bed material 4 required for the fluidized bed; the other is unburned carbon that, when the gasification reactor processes gasification, all matters do not burn out like what would happen in combustion provided with excess oxygen; therefore, there must be some unburned carbon (i.e., unreacted solid carbon) in the gasification zone, which does not complete the reaction and flows with the bed material 4 into the third dense bed 32. As shown in FIG. 2, with the feeding of omitted material in FIG. 1, the flow of the bed material 4 is demonstrated. The stack bed heights 9 show that the bed material 4 will be accumulated to a certain height in the dense beds, which not only increase the driving forces toward the gasification zones but also isolate the entering of gases from the gasification zones. As shown in FIG. 2, the bed material 4 enters the first or second gasification zone 11, 21 through the first or second orifice 121, 221 at the bottom end 12, 22; and is carried by the fluidizing gas 5 to flow up across the first or second weir egress 111, 211, respectively. After flowing across the first or second weir egress 111, 211, the bed material 4 is accumulated in the third dense bed 32 and, then, enters the combustion zone 31 through the third orifice 321. In the combustion zone 31, air or an oxygen-rich gas (e.g. sort of pure oxygen) may be used so that the unburned carbon may be burned; and, if necessary, some auxiliary fuel may be added. The main purpose is to re-heat the bed material 4 in the combustion zone 31 to a preset temperature (e.g. 850° C.). After reaching the preset temperature, the bed material 4 enters the first or second dense bed 12, 22 through the third weir egress 311 above the combustion zone 31; and, then, is conveyed back to the first or second gasification zone 11, 21 through the first or second orifices 121, 221, respectively. A whole cycle as described above is thus formed to be processed repeatedly.

The gasification reactor according to the present invention uses an interconnected design. The interconnected fluidized beds are applied in gasification. The connecting piping between the two gasification areas are separately replaced with dense beds to be integrated for forming a single reactor. Thus, the present invention simplifies the system, saves the cost and reduces the operation difficulty.

The whole cycle has two key points:

(1) The separation has the following reason: After the two parts of gasification and combustion of the present invention are separated, the corresponding gases are separated too. In another word, if pure oxygen along with $CO_2$ is used in the combustion zone, the gas outputted from the combustion zone has the possibility of being a high purity gas of $CO_2$, which saves the purification cost of $CO_2$ obtained for sequestration or utilization. If general air is used, a high proportion of nitrogen exists so that the gas generated from the combustion zone is a flue gas to be treated in a general way.

(2) During the gasification in the gasification zones, the combustible gas generated in the present invention is a synthesis gas, comprising CO, $H_2$ and, sometimes, a small amount of $CO_2$. If subsequent application exists, nitrogen is not favorable no matter for separation nor chemical conversion for nitrogen will make the apparatus large. In addition, another utility is required for nitrogen separation.

The benefits for separating the two parts include:

1. At first, the gas in the combustion zone can be processed randomly with adjustment according to the operation and waste needs. Secondly, the gases in the gasification zones are not affected by nitrogen so that gas volume is reduced. Not only the space for subsequent apparatus is saved, but also the cost of nitrogen separation is reduced. For example, the gasifying agent 7 conveyed into the first or second gasification zone 11, 21 in FIG. 1 can be air, vapor or an oxygen-rich gas. If vapor or an oxygen-rich gas is used, the generated gas will contain no nitrogen so that the combustible gas is more applicable in subsequent applications.

2. For the convenience of applications, as the two parts are divided in the present invention, air can also be used to process treatment in the combustion zone for saving the cost, which applies the concept of indirect gasification. The present invention realizes the concept in the form of using interconnected fluidized beds. Regarding handling different source materials (e.g. corrosive source material), if independent handling is required owing to different operating point, a complete gasification will be required. Then, by applying the connection characteristic of the interconnected cavity areas, an additional gasification area can be connected with the combustion area at the other end, where a case is formed with the gasification areas 1, 2 at two sides of the combustion area 3 shared at center as shown in FIG. 1. Thereby, simultaneous processing of two or more separated source materials is achieved. Moreover, the design of the shared combustion area saves operation cost and further cuts down the occupation of land and space to benefit in industrial development.

As is described above, the present invention uses interconnected fluidized beds as a carrier of the art to realize indirect gasification. As compared to prior arts, by the design of dense beds, required piping connections and easily-blocked seals are replaced so that the geometry of the reactor is simplified and the operation of the reactor is more convenient. Besides, because the seals are replaced by reactor cavities and the conveyance of bed material and airtightness are realized by the design of weir egresses and orifices, the scalability and flexibility for expanding system are achieved.

To sum up, the present invention is a gasification reactor with shared partial reactor vessels, where interconnected fluidized beds is applied in gasification to separately replace connecting vessels between first and second gasification areas with dense beds to be integrated for forming a single reactor; the system is simplified, the cost is saved and the operation difficulty is reduced; by applying the connection characteristic of interconnected cavity areas, an additional gasification area is connected with a combustion area at a contrast end to achieve simultaneous processing of two or more separated source materials; and the design of the shared combustion area saves operating cost and further cuts down the occupation of land and space to benefit in industrial development.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A gasification reactor with shared partial reactor vessels, comprising: an integrated single reactor with interconnected dense fluidized beds comprising:

a first gasification area, wherein said first gasification area comprises a first gasification zone and a first fluidized dense bed; a first weir egress is located at an upper end of a side wall of said first gasification zone; and a first orifice is disposed on at a lower end of a side wall of said first fluidized dense bed to connect to said first gasification zone;

a second gasification area, wherein said second gasification area comprises a second gasification zone and a second fluidized dense bed; a second weir egress is located at an upper end of a side wall of said second gasification zone; and a second orifice is disposed on at a lower end of a side wall of said second fluidized dense bed to connect to said second gasification zone; and a shared combustion area, wherein said shared combustion area is located between and communicated with said first and second gasification areas; said shared combustion area comprises a combustion zone and a third fluidized dense bed; said third fluidized dense bed isolates gases of said combustion zone from said first and second gasification areas; a third orifice is disposed on at a lower end of a side wall of said third fluidized dense bed to connect to said combustion zone; said third fluidized dense bed communicates with said first and second gasification zones through said first and second weir egresses at upper ends of two side walls of said third fluidized dense bed, respectively; and said combustion zone communicates with each of said first and second fluidized dense beds through a third weir egress at an upper end of a corresponding one of side walls of said combustion zone.

2. The gasification reactor according to claim 1, wherein said first gasification area introduces a fluidizing gas to said first fluidized dense bed; said bed material enters said first gasification zone through said first orifice at a lower end of said first fluidized dense bed; a first source material and a gasifying agent are added into said first gasification zone to process gasification to obtain a combustible gas; and unreacted part of said first source material and said bed material in said first gasification zone are carried by said fluidizing gas to flow across said first weir egress.

3. The gasification reactor according to claim 2, wherein said combustible gas is a synthesis gas comprising carbon monoxide (CO), hydrogen (H2) and a small amount of carbon dioxide (CO2).

4. The gasification reactor according to claim 1, wherein said second gasification area introduces a fluidizing gas to said second fluidized dense bed; said bed material enters said second gasification zone through said second orifice at a lower end of said second fluidized dense bed; a second source material and a gasifying agent are added into said second gasification zone to process gasification to obtain a combustible gas; and unreacted part of said second source material and said bed material in said second gasification zone are carried by said fluidizing gas to flow across said second weir egress.

5. The gasification reactor according to claim 4, wherein said combustible gas is a synthesis gas comprising CO, H2 and a small amount of CO2.

6. The gasification reactor according to claim 1, wherein at least one feeding module is further connected to feed in at least two source materials; and each of said source materials is selected from a group consisting of a solid material, a liquid material and a gas material.

7. The gasification reactor according to claim 6, wherein said source materials are selected from a group consisting of the same source materials containing carbon and different source materials containing carbon.

8. The gasification reactor according to claim 1, wherein said shared combustion area introduces a fluidizing gas to said third fluidized dense bed; after entering into said third fluidized dense bed through said first and second weir egresses to be accumulated at a lower end, unreacted part of said source material in said first and second gasification areas is conveyed with said bed material to said combustion zone through said third orifice; unreacted part of said source material is reacted in said shared combustion area to heat up said bed material and generate CO2 after complete combustion is finished; said bed material heated-up enters into said first and second fluidized dense beds through said third weir egress at upper ends of two side walls of said combustion zone and, then, is conveyed back to said first and second gasification zones through said first and second orifices, respectively; and a whole cycle as described above is obtained to be processed repeatedly.

9. The gasification reactor according to claim 8, wherein said combustion zone is further heated up to a preset temperature of 600~1100 Celsius degrees (° C.) to process reaction with unreacted part of said source material to heat up said bed material.

10. The gasification reactor according to claim 8, wherein, by processing said whole cycle, said bed material obtains an ability selected from a group consisting of (i) providing energy required during gasification in said first and second gasification zones; and (ii) helping maintaining a reaction temperature.

11. The gasification reactor according to claim 10, wherein said reaction temperature is 600~1100° C.

12. The gasification reactor according to claim 1, wherein at least one gas supply module is further connected to provide a gasifying agent to said first and second gasification zones to convey a gas selected from a group consisting of air, vapor and an oxygen-rich gas to said first and second gasification zones to convert source materials into combustible gases; and wherein said gasifying agent is provided to said combustion zone to convey a gas selected from a group consisting of air and an oxygen-rich gas to said combustion zone to heat up said bed material and generate a gas selected from a group consisting of a flue gas and a high-purity gas of CO2.

* * * * *